United States Patent [19]

Fukuda et al.

[11] 4,202,937

[45] May 13, 1980

[54] ELECTROPHOTOGRAPHIC PHOTOSENSITIVE MEMBER HAVING NO FATIGUE EFFECT

[75] Inventors: Tadaji Fukuda, Toride; Isamu Kajita, Yokohama; Teruo Misumi, Toride; Hideyo Kondo, Toride; Nobuo Kitajima, Toride, all of Japan

[73] Assignee: Canon Kabushiki Kaisha, Tokyo, Japan

[21] Appl. No.: 797,817

[22] Filed: May 18, 1977

[30] Foreign Application Priority Data

May 27, 1976 [JP] Japan ..... 51-62134

[51] Int. Cl.[2] ..... G03G 5/08; G03G 5/082

[52] U.S. Cl. ..... 430/58; 430/60; 430/67; 430/84; 430/85; 427/76

[58] Field of Search ..... 96/1.5, 1 PC; 427/76

[56] References Cited

U.S. PATENT DOCUMENTS

| | | | |
|---|---|---|---|
| 2,962,376 | 11/1960 | Schaffert | 96/1.5 |
| 3,653,064 | 3/1972 | Inoue et al. | 96/1.5 |
| 3,655,377 | 4/1972 | Sechak | 96/1.5 |
| 3,708,291 | 1/1973 | Kinoshita et al. | 96/1.5 |
| 3,966,512 | 6/1976 | Nonaka | 427/76 X |
| 4,021,375 | 5/1977 | Moore | 96/1.5 X |
| 4,026,703 | 5/1977 | Hayashi et al. | 427/76 X |

*Primary Examiner*—Roland E. Martin, Jr.
*Assistant Examiner*—John L. Goodrow
*Attorney, Agent, or Firm*—Fitzpatrick, Cella, Harper & Scinto

[57] ABSTRACT

An electrophotographic photosensitive member having an insulating layer overlaid on the one side of an amorphous photoconductive layer is characterized in that said photosensitive member further comprises two layers: a charge injection layer and a subsidiary charge injection layer overlaid on the other side of the photoconductive layer with the subsidiary charge injection layer being interposed between the photoconductive layer and the charge injection layer, said subsidiary charge injection layer having a lower free charge density than that in the photoconductive layer and being able to make it easy to inject an amount of electric charge from the charge injection layer into the photoconductive layer whereas said charge injection layer has a higher free charge density than that in the photoconductive layer and serves as a main supply source of the electric charge to be injected into the photoconductive layer.

14 Claims, 10 Drawing Figures

ELECTROPHOTOGRAPHIC PHOTOSENSITIVE MEMBER HAVING NO FATIGUE EFFECT

BACKGROUND OF THE INVENTION

1. Field of the Invention

The present invention relates to a photosensitive member for electrophotography and more particularly to a photosensitive member for electrophotography having no fatigue effect.

2. Description of the Prior Art

Various types of photosensitive members for electrophotography are known and in accordance with the electrophotographic process to be employed, a most suitable type of photosensitive member is selected among them. A photosensitive member of the type which has an insulating layer on its top surface is used to form an electrostatic latent image on the insulating layer. For such a type of photosensitive member, it is required to inject an amount of charge into the interface between the insulating layer and the photoconductive layer by charging. As an example of the electrophotographic process for which such a type of photosensitive member is suitably used, mention may be made of a process comprising the steps of a primary charging, an imagewise exposure, an AC discharging simultaneous with or after the imagewise exposure or a secondary charging with a polarity opposite to that of the primary charging and a whole surface exposure. In case that the photoconductive layer is composed of a p-type semiconductor such as Se, SeTe or the like, the primary charging is effected by corona discharging with negative polarity and a certain amount of positive charge is injected into the photoconductive layer through its support so that the charge may be migrated into the interface between the insulating layer and the photoconductive layer under the effect of an electric field applied on the latter. When it is difficult to inject the charge through a support, an alternative method can be employed according to which the photosensitive member is uniformly exposed to a light just before or simultaneously with the corona discharge with negative polarity so that a suitable amount of positive charge may be present in the interface between the insulating layer and the photoconductive layer. If this exposure to light is carried out from the side of the support, the support must be of light transmissive material such as Nesa glass, resin film and the like. In case that the photoconductive layer is composed of a n-type semiconductor, the polarity of charging will be positive and the charge migrated into the interface will be negative. Such an injection of a suitable amount of charge between the insulating layer and the photoconductive layer is absolutely necessary to produce an electrostatic image having a high electrostatic contrast. To this end, if the electric conductive support is made of metal, for example, an attempt has been made to provide a charge injection layer between the support and the photoconductive layer as disclosed in Japanese Patent Publication No. 6223/1974. The charge injection layer serves to supply an adequate amount of charge into the photoconductive layer when charging is effected, and the charge thus supplied contributes to making a suitable amount of charge present between the insulating layer and the photoconductive layer. However, it has been found that even when such a charge injection layer is provided, a further improvement should be made.

That is, when the photosensitive member should be repeatedly used and when the cycle of the repeated use is increased up in the speed, it is often observed that the amount of charge existing in the interface between the insulating layer and the photoconductive layer is gradually decreased and as a result the contrast of an image formed after many times of repeated use is remarkedly reduced. This disadvantageous phenomenon may be explained as a fatigue effect of the photosensitive member.

SUMMARY OF THE INVENTION

Accordingly it is the primary object of the present invention to provide a photosensitive member which does not show such a fatigue effect even after it has been repeatedly used many times at a high cyclic speed.

In accordance with the present invention, an electrophotographic photosensitive member having an insulating layer overlaid on the one side of an amorphous photoconductive layer which is characterized in that said photosensitive member further comprises two layers: a charge injection layer and a subsidiary charge injection layer overlaid on the other side of the photoconductive layer with the subsidiary charge injection layer being interposed between the photoconductive layer and the charge injection layer, said subsidiary charge injection layer having a lower free charge density than that in the photoconductive layer and being able to make it easy to inject an amount of electric charge from the charge injection layer into the photoconductive layer whereas said charge injection layer has a higher free charge density than that in the photoconductive layer and serves as a main supply source of the electric charge to be injected into the photoconductive layer.

The above and further objects and novel features of the invention will more fully appear from the following detailed description in connection with the accompanying drawings.

DESCRIPTION OF THE PREFERRED EMBODIMENTS

The object of the present invention is attained by providing a subsidiary charge injection layer as described above. The subsidiary charge injection layer plays an important role in producing an effective migration of charge injected from the charge injection layer into the photoconductive layer. To perform the function, the subsidiary charge injection layer is made as a layer which has almost no ability to inject any amount of charge into the photoconductive layer from itself and has a lower free charge density in it than that in the photoconductive layer.

Figure 1:
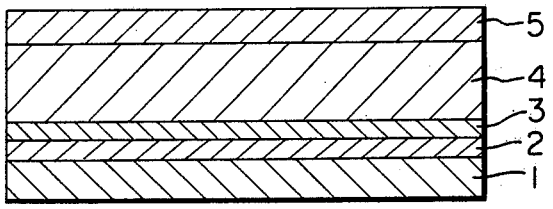
FIGS. 1 and 2 illustrate two examples of the electrophotographic photosensitive member according to the present invention.
Figure 2:
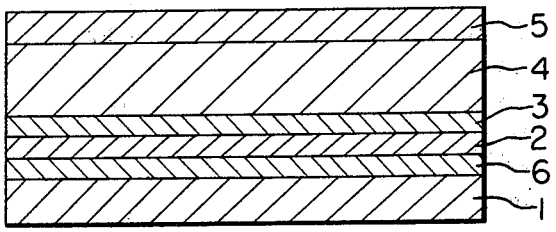

Representative examples of the arrangement of the photosensitive member according to the invention are shown in FIGS. 1 and 2.

The photosensitive member illustrated in FIG. 1 is composed of a support 1, a charge injection layer 2, a subsidiary charge injection layer 3, a photoconductive layer 4 and an insulating layer 5. At least either one of the insulating layer and the photoconductive layer is transmissive to the light (radiation rays) to which the photoconductive layer is sensitive. The support may be electrically conductive or insulative. Examples of a conductive support include a sheet of metal such as Al, Ni, brass, Cu and Ag or conductive glass. Examples of a dielectric support material are a resin such as polyester and polyethylene, paper, glass and ceramics.

The photoconductive layer may be formed from various amorphous semiconductors which have been known and used as a suitable photoconductive material for electrophotography. As typical examples of such an amorphous semiconductor material, mention may be made of Se, alloys containing Se such as SeTe, SeAs, SeSb, SeBi or SeTeAs and their mixtures with other element(s). Preferably the photoconductive layer has a dark electric resistance in the range of from about $1\times10^{14}\Omega$.cm to about $1\times10^{12}\Omega$.cm.

The insulating layer is generally formed by using a suitable resin. Examples of the suitable resin are polyester, polyparaxylylene, polyurethane, polycarbonate and polystyrene.

The charge injection layer must be a layer which has therein a higher density of free charge than that in the photoconductive layer and does not build any electrical barrier between the charge injection layer and a layer that forms a junction together with said charge injection layer, that is, the subsidiary charge injection layer. The charge injection layer has, as indicated by the name, to supply a sufficient amount of charge enough to make a suitable amount of charge present in the interface between the photoconductive layer and the insulating layer when charging is effected. For this purpose, the material to be used for making the charge injection layer should be selected taking the following requirements into consideration:

(1) If the subsidiary charge injection layer is a p-type semiconductor, then the material of the charge injection layer should have a work function which is the same or larger than the work function of the former layer. On the contrary, if the subsidiary charge injection layer is a n-type semiconductor, the material of the charge injection layer should have a work function which is the same or smaller than that of the n-type semiconductor layer.

(2) The charge injection layer should be able to produce a sufficient amount of free charge with a relatively smaller thermal energy somewhat equal to room temperature (low dark resistance).

Preferably the charge injection layer has a dark resistance of about $1\times10^{10}\Omega$.cm or below, particularly, of about $1\times10^{9}\Omega$.cm or below. When a p-type amorphous semiconductor such as Se and SeTe is used for the photoconductive layer, the charge injection layer is preferably formed by using a material having a relatively large work function such as Te or the same material as that of the photoconductive layer but in a crystallized form.

In the photosensitive member of the present invention, the photoconductive layer, the subsidiary charge injection layer and the charge injection layer are united together without building any electrical barrier therebetween. The charge injection layer has a dark resistance far lower than that of the photoconductive layer and a free charge density much higher than that of the latter layer. The material actually used for forming the charge injection layer must be suitably selected depending upon the type of the photoconductive layer and the characteristics required for the photosensitive member. In general, examples of material useful for the charge injection layer include metals such as Ni and Pt and semiconductors such as Te, Se, SeTe, SeAs, SeBi and SeSb. In particular, a crystalline material is preferable. The charge injection layer may be formed as a support. In this arrangement, a separate support will become unnecessary.

The subsidiary charge injection layer is of a lower free charge density and a higher dark resistance compared with the photoconductive layer. It is preferably amorphous. The dark resistance for the subsidiary charge injection layer is preferably above some $1\times10^{14}\Omega$.cm and in particular above some $1\times10^{15}\Omega$.cm. The material for forming the subsidiary charge injection layer is selected from materials which are able to effectively assist in charge injection. Examples of a material preferably used for this purpose are Se and alloys containing Se such as SeTe, SeAs, SeBi and SeSb. Amorphous semiconductors essentially composed of Se or the above mentioned alloys thereof are preferable.

The photosensitive member shown in FIG. 2 differs from the example of FIG. 1 in that a second underlaid insulating layer 6 is additionally provided between the support 1 and the charge injection layer 2. The underlaid insulating layer 6 may be formed using a suitable dielectric material, for example, a resin such as polyester or paraxylylene, metal oxide or glass. As to the subsidiary charge injection layer, further explanation will be made in the following referential examples 1 and 2, and related description with reference to FIGS. 3 through 5.

REFERENTIAL EXAMPLE 1

(The prior art process for manufacturing a photosensitive member, and the characteristics of the member)

Figure 3:
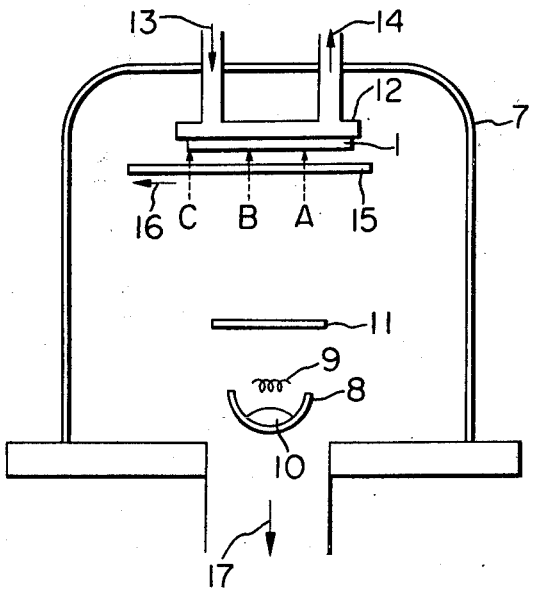
FIG. 3 schematically shows one example of the vapor depositing apparatus suitable for manufacturing the electrophotographic photosensitive member of the invention.

A metallic substrate plate 1 of the size $50\times100$ mm made from aluminum which serves as a support for the photosensitive member as described above is brought into close contact with a substrate temperature control plate 12 arranged within a vapor depositing vessel 7 as illustrated in FIG. 3.

70 g of SeTe alloy (Te content: 10 wt%) as a vapor depositing material 10 is charged into a quartz vapor depositing boat 8 and then a tungsten spiral heater 9 is disposed above the boat. Thereafter, the air in the vessel is exhausted in the direction indicated by the arrow 17 so as to establish a vacuum of $5\times10^{-5}$ torr in it.

After having adjusted the temperature of circulating water to 80° C., the water is circulated as indicated by the arrows 13 and 14 as to warm the substrate temperature control plate. When the temperature of the substrate has reached 80° C., the tungsten heater is turned on and heats the vapor depositing boat up to 320° C. so that the SeTe alloy may melt and begin evaporation. At the time point $t_{1-1}$ (see FIG. 4) when the SeTe alloy has completely and uniformly melted, a shutter 11 is opened and also slides a shutter 15 is slid from the right to the left as viewed in the drawing in the direction of arrow 16 until its trailing edge reaches the point A. Now, to the right side portion of the substrate (one third of the total surface area of the substrate), vapor depositing with SeTe is started. At the next time point $t_{1-2}$, the film thickness of the vapor deposition film formed on the substrate reaches 5μ. At this time point, the temperature of the circulating water is lowered to 65° C. and at the same time the shutter 15 is slid further more leftwards up to the point B to effect vapor depositing with SeTe also on the central portion of the substrate. The time required for lowering the substrate temperature from 80° C. to 65° C. is about ten minutes. The time point when the substrate temperature has reached 65° C. is indicated by point $t_{1-3}$. At this time point, the shutter 15 is slid further more to a fully opened position to effect vapor depositing with SeTe on the whole surface of the substrate. Thereafter, vapor depositing is continued while keeping the substrate temperature at 65° C.

When the SeTe within the vapor depositing vessel has almost completely evaporated off the vessel at the time point $t_{1-4}$, the heater is turned off and the vapor depositing is finished.

Figure 4:
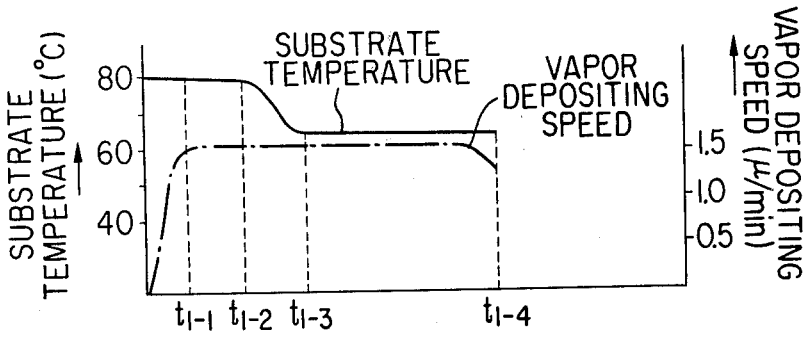
FIG. 4 is a vapor depositing curve showing the vapor depositing conditions used for manufacturing the electrophotographic photosensitive member according to the prior art.

The vapor deposition film thus formed on the substrate had the thickness of 55μ at the area to which vapor depositing was effected for the depositing time from $t_{1-1}$ to $t_{1-4}$, 50μ at the portion deposited for $t_{1-2}$–$t_{1-4}$ and 40μ at the portion deposited for $t_{1-3}$–$t_{1-4}$. The vapor depositing speed of the deposition film on the substrate was about 1.5 μ/min. as shown in FIG. 4. FIG. 4 shows the substrate temperature curve and the vapor depositing speed curve depending upon time, obtained from the above described vapor depositing process.

After breaking the vacuum, the vapor deposited substrate was taken out from the vessel and a polycarbonate resin coating 20μ thick was overlaid on the vapor deposited surface in the atmosphere. In this manner, a photosensitive member was produced.

To the portion of the photosensitive member thus vapor deposited for the time period $t_{1-1}$–$t_{1-4}$, as a primary charging step, corona discharging with negative polarity of −6000 V was carried out for 0.2 sec. so that the member was charged with −2000 V. As a secondary charging step, corona discharging with positive polarity of +5500 V was carried out for 0.2 sec. to discharge the surface of the insulating layer. After carrying out a whole surface exposure to it, the photosensitive member exhibited a surface voltage (potential) of −800 V.

Figure 5:
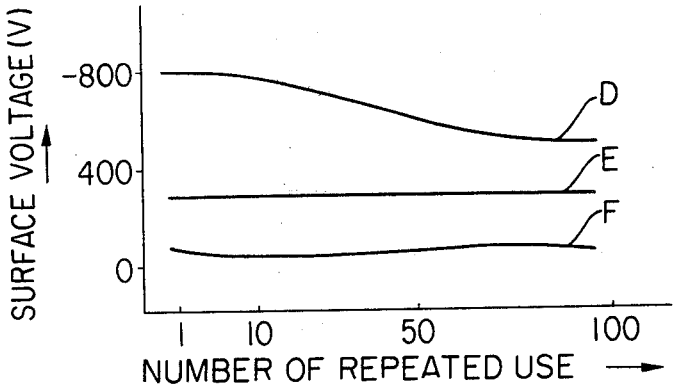
FIG. 5 is a surface voltage (or potential) characteristic curve obtained from the prior art photosensitive member.

This process was repeated many times at a cycle of every 2 sec. and it was found that the surface voltage after the whole surface exposure was decreased gradually with the increase in number of times of repeated use. After one hundred repetitions, its surface voltage after the whole surface exposure was measured at −500 V. This change in the surface voltage is shown in FIG. 5 as a curve D.

To the portion of the photosensitive member vapor deposited for the time period $t_{1-2}$–$t_{1-4}$, the same process was also carried out with the same charging voltage. After a whole surface exposure, its surface voltage was measured and found to be −300 V. After one hundred times of repetition with the cycle of 2 sec., the value of the surface voltage after whole surface exposure of the photosensitive member remained unchanged at −300 V. The curve E of FIG. 5 shows this change in the surface voltage.

Also, to the portion of the photosensitive member vapor deposited for the time period from $t_{1-3}$ to $t_{1-4}$, the same process was carried out with the same charging voltage. After a whole surface exposure, its surface voltage was measured and found to be −50 V.

After one hundred times of repeated use with 2 sec. cycle, the surface voltage remained unchanged at −50 V. This change in the surface voltage is shown in FIG. 5 as a curve F.

When a photosensitive member is operated according to the process comprising the steps of primary charging, discharging and whole surface exposure, the value of its surface voltage (or potential) after the whole surface exposure is nearly reciprocally proportional to the electric field value at the photoconductive layer after the primary charging. In other words, the surface voltage (or potential) is directly proportional to the number of electric charges which have been injected into the photoconductive layer and migrated into the interface between the photoconductive layer and the insulating layer under the effect of the electric field applied to the photoconductive layer.

In view of the fact of this correlation, the very small surface voltage, −50 V found after whole surface exposure at the portion vapor deposited for the time period $t_{1-3}$–$t_{1-4}$ should be understood to mean that the number of free charges produced in the photosensitive layer during the primary charging was very small.

The surface voltage after whole surface exposure of the portion vapor deposited for the time period $t_{1-2}$–$t_{1-4}$ was measured to be −300 V which is far larger that of the above said portion. This fact will mean that the number of electric charges injected into the photoconductive layer of that portion was not a few. The injection source of such not a few charges is believed to have existed in the deposition film vapor deposited for the time period $t_{1-2}$–$t_{1-3}$, which deposition film is hereinafter referred to as ($t_{1-2}$–$t_{1-3}$) layer.

Lastly, the corresponding surface voltage of the portion vapor deposited for the time period $t_{1-1}$–$t_{1-2}$ was measured to be −800 V which was the highest value among the surface values of three different measured portions described above. This high surface voltage is attributable to the fact that a sufficient number of electric charges were initially injected by its crystalline deposition film vapor deposited for the time period $t_{1-1}$–$t_{1-2}$ which is hereinafter referred as ($t_{1-1}$–$t_{1-2}$) layer. However, with an increase in the number of times of repeated use, the number of electric charges injected into the photoconductive layer is gradually decreased and, in proportion to it, the surface voltage after whole surface exposure of the photosensitive member is also reduced gradually (shift toward zero(0) point). Thereby, it begins showing a fatigue effect and the ($t_{1-1}$–$t_{1-2}$) layer becomes unable to fully function as a charge injection layer. As will be seen from the above described explanation, this simple portion of the photosensitive member has in fact two charge injection layers, i.e. ($t_{1-1}$–$t_{1-2}$) layer and ($t_{1-2}$–$t_{1-3}$) layer. The number of electric charges injected into the photoconductive layer from the ($t_{1-2}$–$t_{1-3}$) layer at the time of primary charging remains constant irrespective of the number of repeated use as will be understood from the above described result of repeated use of the portions vapor deposited for the time period $t_{1-3}$–$t_{1-4}$. Therefore, the decrease in number of electric charges injected into the photoconductive layer is mainly caused by the corresponding decrease in number of electric charges injected into the photoconductive layer from the ($t_{1-1}$–$t_{1-2}$) layer with the increased number of repeated use.

At the time of primary charging, electric charges are injected into the photoconductive layer from ($t_{1-1}$–$t_{1-2}$) layer as well as from ($t_{1-2}$–$t_{1-3}$) layer, and the electric charges from the former will move to the photoconductive layer passing through the latter layer. But, when the charge starts moving from the ($t_{1-1}$–$t_{1-2}$) layer towards the photoconductive layer, the ($t_{1-2}$–$t_{1-3}$) layer also begins injecting some amount of charge into the photoconductive layer at the same time. Therefore, the charge coming from the ($t_{1-1}$–$t_{1-2}$) layer will reach the ($t_{1-2}$–$t_{1-3}$) layer after the charge produced from the ($t_{1-2}$–$t_{1-3}$) layer has already moved to the photoconductive layer. For the reason, the intensity of electric field applied to the ($t_{1-2}$–$t_{1-3}$) layer when the charge coming from the ($t_{1-1}$–$t_{1-2}$) reaches the ($t_{1-2}$–$t_{1-3}$) layer has reduced compared with the initial intensity of the electric field. Accordingly, there cannot be present in the ($t_{1-2}$–$t_{1-3}$) layer a sufficient electric field enough to make all of the electric charges coming from the ($t_{1-1}$–$t_{1-2}$) layer passed through the ($t_{1-2}$–$t_{1-3}$) layer. As a result, some of electric charge produced from the ($t_{1-1}$–$t_{1-2}$) layer cannot be injected into the photoconductive layer, but remain behind within the ($t_{1-2}$–$t_{1-3}$) layer to be lost by recombination or to exist as trapped charges. Thus, when the photosensitive member is repeatedly used at a relatively short cycle of time, the trapped charges are accumulated within or near about the ($t_{1-2}$–$t_{1-3}$) layer and due to the effect of space charge caused by the accumulation of the trapped charges, the charge injection from the ($t_{1-1}$–$t_{1-2}$) into the photoconductive layer becomes difficult more and more. This may be considered as a principal cause for the gradual decrease of surface voltage after whole surface exposure with increasing number of repeated use of the photosensitive member. The density of free charge in the ($t_{1-2}$–$t_{1-3}$) layer formed according to the prior art is high, which attributes to the above described disadvantageous phenomenon.

REFERENTIAL EXAMPLE 2

(Photosensitive member according to the present invention)

The above described disadvantageous phenomenon such as decrease in the injected charge can be solved by interposing a subsidiary charge injection layer between the charge injection layer and the photoconductive layer. According to the present invention, the photosensitive member comprises the above described ($t_{1-2}$–$t_{1-3}$) layer as a subsidiary charge injection layer which has a relatively low density of free charge and therefore allows to thermally produce a relatively small number of free charges. Thus, the charge injected into the photoconductive layer from the subsidiary charge injection layer itself becomes very few and the electric field intensity between the charge injection layer and the photoconductive layer is no longer reduced, which in turn allows a smooth charge injection from the ($t_{1-1}$–$t_{1-2}$) layer i.e. charge injection layer into the photoconductive layer. Furthermore, since the charge injected from the ($t_{1-1}$–$t_{1-2}$) layer is no longer blocked by the subsidiary charge injection layer, the gradual decrease of surface voltage as described above is prevented even if the photosensitive member is used repeatedly many times.

The subsidiary charge injection layer can be formed by adopting suitable mode of manufacture according to which a low density of free charge may be attained.

Some examples of suitable manufacturing mode are as follows:

(1) To use a lower substrate temperature for forming the subsidiary layer than that for forming other layers (charge injection layer and photoconductive layer).

(2) To use a lower vapor depositing rate (speed) for forming the subsidiary layer than that for other layers.

(3) To select, as a subsidiary layer forming material, such a material that has an property similar to that of a combined type of semiconductor. For example, in case of p-type semiconductor, the inherent property of p-type should be weakened by doping with impurity so as to convert it into a semiconductor having a property near to that of a combined type of semiconductor suitable for the subsidiary charge injection layer.

(4) To control the vacuum and the gaseous atmosphere for vapor depositing.

Each of the above mentioned manufacturing modes (1)–(4) may be used alone or used as two or more combinations thereof as will be described hereinafter in the Examples. Besides the Examples, for example, when Te is used for the charge injection layer and Se or SeTe is employed for the subsidiary charge injection layer and photosensitive layer, it is recommendable to effect vapor depositing with Se or SeTe overlaid on the charge injection layer under the condition selected from the following:

(a) To lower the substrate temperature at the beginning of vapor depositing;

(b) To lower the vapor depositing speed (or rate) at the beginning of vapor depositing;

(c) To carry out vapor depositing in the presence of a suitable amount of atmospheric air at the beginning of it; and (d) To use, as vapor depositing material, at first Se or SeTe dope with an impurity such as Tl or Fe, and next use Se or SeTe.

By employing one or more of the conditions mentioned above, an effective subsidiary charge injection layer can be formed at the beginning stage of the vapor depositing.

A preferable concrete example of the above mentioned manufacturing mode (1) is that: man keeps the substrate temperature above some 75° C. during the charge injection layer forming stage: temporarily or continuously reduces it to a temperature under some 55° C. for forming the subsidiary charge injection layer, and for the photoconductive layer forming stage, man adjusts it to a temperature between about 60° C.–about 70° C.

A preferable example of the mode (2) is that: man keeps the vapor depositing rate at the value of about 1 μ/min.–5 μ/min. for the charge injection layer forming stage, about 0.1 μ/min.–0.5 μ/min. for the subsidiary charge injection layer forming stage and about 1 μ/min.–3 μ/min. for the photoconductive layer forming stage.

A preferable example of the mode (4) is that: man adjusts the vacuum degree to a value between about $2\times10^{-4}$ and about $1\times10^{-3}$ torr for forming the subsidiary charge injection layer and increases it by one figure or more for forming the charge injection layer and the photoconductive layer.

The thickness of each the layers of the photosensitive member may be suitably selected. For the charge injection layer, the range of 0.2–15μ is suitable, in particular the range of 2–10μ is preferable. For the subsidiary charge injection layer, 0.2–20μ and in particular the range of 2–15μ is preferable. For the photoconductive layer, 10–100μ and in particular the range of 25–80μ is preferable.

As examples of preferable material for forming the photoconductive layer and the subsidiary charge injection layer, mention may be made of Se and Se-containing alloy semiconductors.

If the support is made of material which does not build any electrical barrier relative to the photoconductive layer, the support may be used to serve also as a charge injection layer. In this case, the thickness of said charge injection layer is determined by the condition required for the support.

For example, when Ni is selected for the support and Se or SeTe for both of the subsidiary charge injection layer and the photoconductive layer, a stable and fatigueless photosensitive member also can be manufactured by forming the subsidiary charge injection layer on the substrate, for example, by employing any of the conditions (a)–(d) and then forming thereon the photoconductive layer with Se or SeTe and the transparent insulating layer.

The invention will be understood more readily by reference to the following examples. However, these examples are intended to illustrate the invention and are not to be construed to limit the scope of the invention.

EXAMPLE 1

A metallic substrate of the size 50×100 mm made from aluminum is brought into close contact with a substrate temperature control plate arranged within a vapor depositing vessel as illustrated in FIG. 3.

Figure 6:
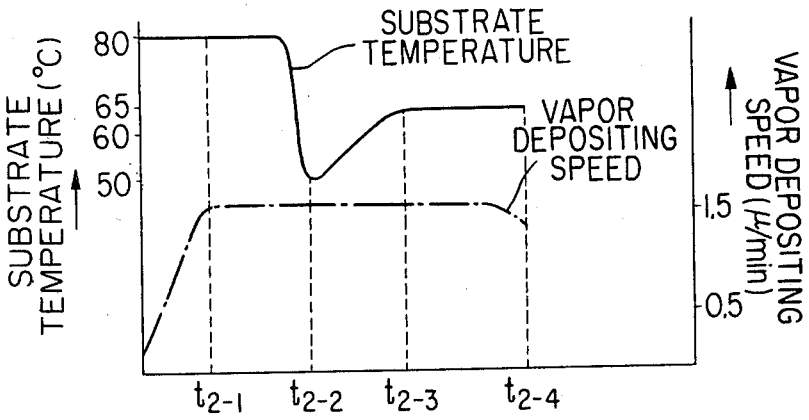
FIG. 6 through 10 are various vapor depositing curves similar to FIG. 4, but obtained from the manufacture of the electrophotographic photosensitive members according to the present invention.

70 g of SeTe alloy (Te content: 10 wt%) is charged into a pyrex vapor depositing boat and then a tungsten spiral heater is disposed above the boat. Thereafter, man exhausts the air in the vapor depositing vessel is exhausted so as to establish a vacuum degree of $5\times10^{-5}$ torr in it. Then the temperature of a circulating water is adjusted to 80° C., which is circulated through the substrate temperature control plate. When the temperature of the substrate has reached 80° C., the tungsten heater is turned on and heats the vapor depositing boat up to 320° C. so that the SeTe alloy may melt and begin evaporating. As shown in FIG. 6, at the time point $t_{2\text{-}1}$ when the SeTe alloy has completely and uniformly melted, shutter 11 is opened and also at the same time shutter 15 is slid from the right to the left as viewed in the drawing to its fully opened position. Now, vapor depositing with SeTe on the whole surface of the substrate is started.

At the time when the thickness of the vapor deposition film formed on the substrate reaches about 5μ, the temperature of the circulating water is lowered to 20° C. and allow the substrate temperature is allowed to decrease to 50° C. at the lowering rate of 10° C./min. At the time point $t_{2\text{-}2}$ when it has just reached 50° C., the temperature of the circulating water is raised so as to raise the substrate temperature up to 65° C. at the rising rate of 2° C./min. After the time point $t_{2\text{-}3}$ when it has reached 65° C., the substrate temperature is maintained at the point 65° C.

At the time point $t_{2\text{-}4}$ when the SeTe within the depositing boat has almost completely evaporated off, the tungsten spiral heater is turned off and finishes vapor depositing is finished. After breaking the vacuum, a polycarbonate resin coating of thickness is applied 20μ on the vapor deposited surface. In this manner, a photosensitive member was manufactured. The overall thickness of the vapor deposition film was 55μ. The vapor depositing speed of the deposition film on the substrate was about 1.5 μ/min.

To the photosensitive member produced in the above described Example 1, as a primary charging step, corona discharging with negative polarity of −6000 V was carried out for 0.2 sec. so that the member was charged with −2000 V. As a secondary charging, corona discharging with positive polarity of +5500 V was carried out for 0.2 sec. to discharge the surface of the insulating layer. After carrying out a whole surface exposure to it, the photosensitive member exhibited the surface voltage of −850 V.

This process was repeated many times at the cycle of 2 sec. After one hundred repetitions, its surface voltage after the whole surface exposure was measured and found to remain unchanged at −850 V. No fatigue effect was observed.

EXAMPLE 2

On one side of an aluminum substrate plate of the size 50×100 mm, an Alumite layer 10μ thick is formed according to a chemical processing technique (anodic oxidation). The substrate plate is brought into close contact with a substrate temperature control plate arranged within a vapor depositing vessel as illustrated in FIG. 3 with its Alumite surface side being opposed to a vapor depositing boat. Under the same vapor depositing conditions as those in Example 1, vapor depositing is carried out and also an insulating layer is coated on the vapor deposited surface of the substrate. In this manner, a photosensitive member was produced.

To the photosensitive member produced in the above described Example 2, as a primary charging step, corona discharging with negative polarity of −6000 V was carried out for 0.2 sec. so that the member was charged with −2000 V. As a secondary charging, corona discharging with positive polarity of +5500 V was carried out for 0.2 sec. to discharge the surface of the insulating layer. After carrying out a whole surface exposure to it, the photosensitive member exhibited the surface voltage of −750 V.

This process was repeated many times at the cycle of 2 sec. After one hundred repetitions, its surface voltage after the whole surface exposure was measured and found to remain unchanged at −750 V. No fatigue effect was observed.

EXAMPLE 3

A metallic substrate of the size 50×100 mm made from aluminum is brought into close contact with a substrate temperature control plate arranged within a vapor depositing vessel as illustrated in FIG. 3.

Figure 7:
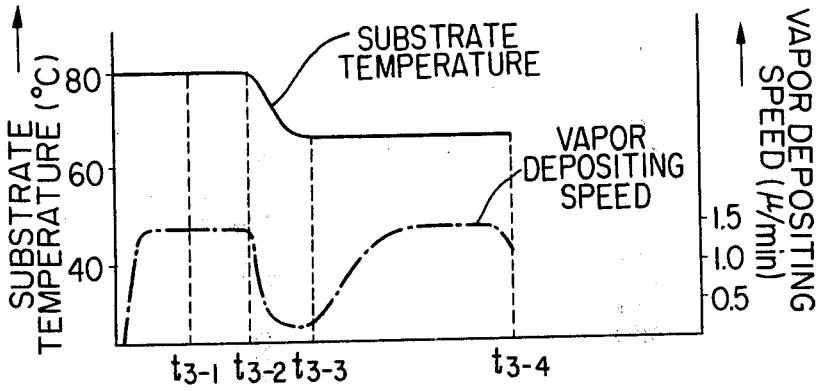

70 g of SeTe alloy (Te content: 10 wt%) is charged into a pyrex vapor depositing boat and then a tungsten spiral heater is disposed above the boat. Thereafter, the air in the vapor depositing vessel is exhausted so as to establish a vacuum degree of $5\times10^{-5}$ torr in it. Then the temperature of a circulating water is adjusted to 80° C., which is circulated through the substrate temperature control plate. When the temperature of the substrate has reached 80° C., the tungsten heater is turned on and heats the vapor depositing boat up to 320° C. so that the SeTe alloy may melt and begin evaporating. As shown in FIG. 7, at the time point $t_{3-1}$ when the SeTe alloy has completely and uniformly melted, shutter 11 is opened and also at the same time shutter 15 is slid from the right to the left as viewed in the drawing to its fully opened position. Now, vapor depositing with SeTe on the whole surface of the substrate is started.

The depositing speed of vapor deposition film is 1.5 μ/min. At the time point $t_{3-2}$ when the thickness of the vapor deposition film formed on the substrate reaches 5μ, shutter 11 is placed and also at the same time shutter 15 is slid from the left to the right to close it, and the tungsten heater is turned off. Thereafter the temperature of the circulating water is lowered from 80° C. to 65° C. and the substrate temperature is allowed to lower to 65° C. At the time point $t_{3-3}$ when it has just reached 65° C., the tungsten heater is again turned on on. At the same time, the shutters 11 and 15 are again opened again fully. Thus, the SeTe again begins vapor depositing on the substrate. But, initially the vapor depositing speed on the substrate is very slow and with raising-up of the temperature of the vapor depositing boat, the speed is gradually raised up. When it reaches the value of 1.5 μ/min., the temperature of the vapor depositing boat is controlled.

At the time point $t_{3-4}$ when the SeTe within the depositing boat has almost completely evaporated off, the tungsten spiral heater is turned off and the vapor depositing is finished. The overall thickness of the vapor deposition film was 55μ. After breaking the vacuum, a polycarbonate resin coating of 20μ thickness is applied on the vapor deposited surface. In this manner, a photosensitive member was manufactured.

To the photosensitive member produced in the above described Example 3, as a primary charging step, corona discharging with negative polarity of −6000 V was carried out for 0.2 sec. so that the member was charged with −2000 V. As a secondary charging, corona discharging with positive polarity of +5500 V was carried out for 0.2 sec. to discharge the surface of the insulating layer. After carrying out a whole surface exposure to it, the photosensitive member exhibited the surface voltage of −780 V.

This process was repeated many times at the cycle of 2 sec. After one hundred repetitions, its surface voltage after the whole surface exposure was measured and found to remain unchanged at −780 V. No fatigue effect was observed.

EXAMPLE 4

A metallic substrate of the size 50×100 mm made from aluminum is brought into close contact with a substrate temperature control plate arranged within a vapor depositing vessel as illustrated in FIG. 3.

Figure 8:
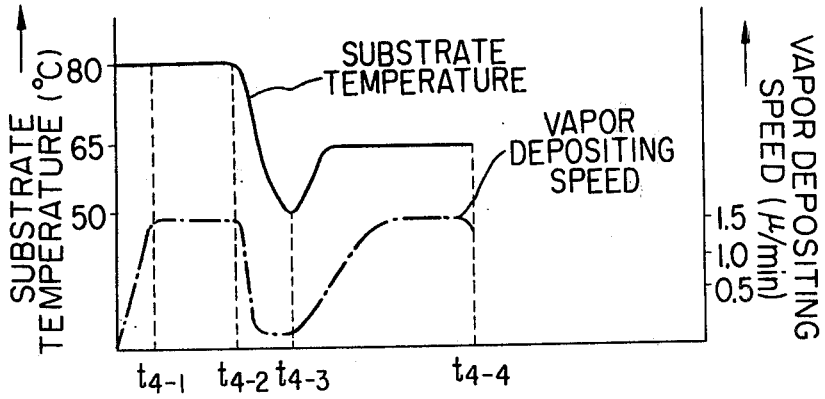

70 g of SeTe alloy (Te content: 10 wt%) is charged into a pyrex vapor depositing boat and then a tungsten spiral heater is disposed above the boat. Thereafter, the air in the vapor depositing vessel is exhausted so as to establish a vacuum degree of $5\times10^{-5}$ torr in it. Then the temperature of a circulating water is adjusted to 80° C., which is circulated through the substrate temperature control plate. When the temperature of the substrate has reached 80° C., the tungsten heater is turned on and the vapor depositing boat is heated up to 320° C. so that the SeTe alloy may melt and begin evaporating. As shown in FIG. 8, at the time point $t_{4-1}$ when the SeTe alloy has completely and uniformly melted, shutter 11 is opened and also at the same time shutter 15 is slid from the right to the left as viewed in the drawing to its fully opened position. Now, vapor depositing with SeTe on the whole substrate is started at the vapor depositing speed of about 1.5 μ/min.

At the time point $t_{4-2}$ when the thickness of the vapor deposition film formed on the substrate reaches 5μ, shutter 15 is slid from the left to the right to close it, the tungsten heater is turned off and also shutter 11 is closed. Then, the temperature of the circulating water is lowered to decrease the substrate temperature up to 50° C. and the temperature is maintained. Again the heater is turned on and at the time point $t_{4-3}$ when the SeTe begins evaporating slightly, the shutters 11 and 15 are fully opened again.

At the same time, the temperature of the circulating water is again raised so as to raise the substrate temperature up to 65° C. at the rising rate of 2° C./min. After the time point when it has reached 65° C., the substrate temperature is kept at the point 65° C. After the time point $t_{4-3}$, the vapor depositing speed of SeTe onto the substrate gradually rises up with the rising up of the temperature of the boat. When it reaches the value of 1.5 μ/min., the temperature of the vapor depositing boat is controlled.

At the time point $t_{4-4}$ when the SeTe within the depositing boat has almost completely evaporated off, the tungsten spiral heater is turned off and vapor depositing is finished. The overall thickness of the vapor deposition film was 50μ. After breaking the vacuum, a polycarbonate resin coating of 20μ thickness is applied on the vapor deposited surface. In this manner, a photosensitive member was manufactured.

To the photosensitive member produced in the above described Example 4, as a primary charging step, corona discharging with negative polarity of −6000 V was carried out for 0.2 sec. so that the member was charged with −2000 V. As a secondary charging, corona discharging with positive polarity of +5500 V was carried out for 0.2 sec. to discharge the surface of the insulating layer. After carrying out a whole surface exposure to it, the photosensitive member exhibited the surface voltage of −750 V.

This process was repeated many times at the cycle of 2 sec. After one hundred repetitions, its surface voltage after the whole surface exposure was measured and found to remain unchanged at −750 V. No fatigue effect was observed.

EXAMPLE 5

A metallic substrate of the size 50×100 mm made from aluminum is brought into close contact with a substrate temperature control plate arranged within a vapor depositing vessel as illustrated in FIG. 3.

Figure 9:
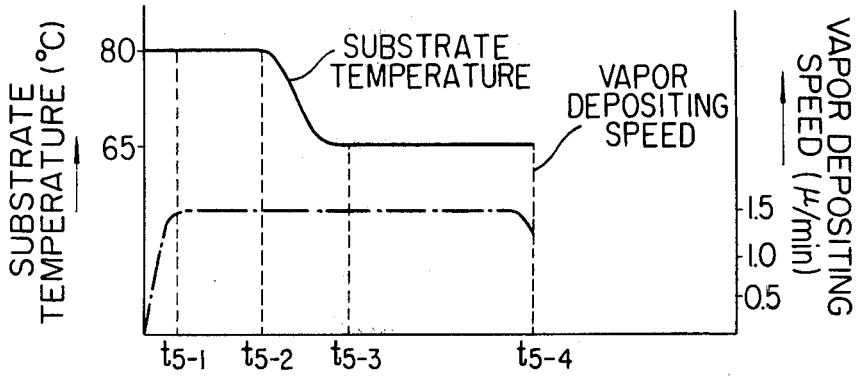

70 g of SeTe alloy (Te content: 10 wt%) is charged into a pyrex vapor depositing boat and then a tungsten spiral heater is disposed above the boat. Thereafter, the air in the vapor depositing vessel is exhausted so as to establish a vacuum degree of $5\times10^{-5}$ torr in it. Then the temperature of a circulating water is adjusted to 80° C. When the temperature of the substrate has reached 80° C., the tungsten heater is turned on and heats the vapor depositing boat up to 320° C. so that the SeTe alloy may melt and begin evaporating. As shown in FIG. 9, at the time point $t_{5-1}$ when the SeTe alloy has completely and uniformly melted, shutter 11 is opened and also at the same time shutter 15 is slid from the right to the left as viewed in the drawing to its fully opened position. Now, vapor depositing with SeTe on the aluminum substrate is started at the vapor depositing speed of 1.5 μ/min.

At the time point $t_{5-2}$ when the thickness of the vapor deposition film formed on the substrate reaches about 5, the temperature of the circulating water is lowered from 80° C. to 65° C. Simultaneously with the lowering of temperature, air is introduced into the vapor depositing vessel by means of a fine adjustable leak valve so as to reduce the vacuum in the vessel from $5\times10^{-5}$ torr to $5\times10^{-4}$ torr. This introduction of air into the vessel is maintained until the time point $t_{5-3}$, that is, about two minutes after the time when the temperature of the substrate has just reached 65° C. under the reduced vacuum. Thereafter, the leak valve is closed, restoring the vacuum to $5\times10^{-5}$ torr, the substrate temperature is kept at 65° C. and vapor depositing is continued.

At the time point $t_{5-4}$ when the SeTe within the depositing boat has almost completely evaporated off, the tungsten spiral heater is turned off and vapor depositing is finished. The overall thickness of the vapor deposition film was 55μ. After breaking the vacuum, a polycarbonate resin coating of 20μ thickness is applied on the vapor deposited surface. In this manner, a photosensitive member was manufactured.

The photosensitive member thus produced exhibited an excellent surface voltage characteristic without any fatigue effect, similar to that of FIG. 4.

Substituting Se for SeTe alloy and employing the temperature of 300° C. for the vapor depositing boat, another photosensitive member was produced in the same manner as described above. Again, an excellent photosensitive member was obtained.

EXAMPLE 6

A metallic substrate of the size 50×100 mm made from aluminum is brought into close contact with a substrate temperature control plate arranged within a vapor depositing vessel as illustrated in FIG. 3.

Figure 10:
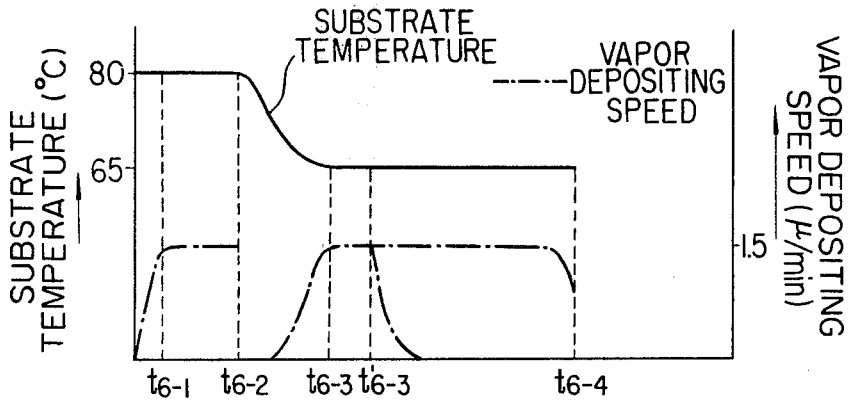

Two pyrex vapor depositing boats are arranged in parallel, one of which is charged with 70 g of Se and the other boat is charged with 30 g of Se doped with 1000 ppm Tl. Then a tungsten spiral heater is disposed above each of the boats and further above the heaters, the shutters $S_1$ and $S_2$ are disposed respectively. Thereafter, the air in the vapor depositing vessel is exhausted so as to establish a vacuum degree of $5\times10^{-5}$ torr in it. Then the temperature of a circulating water is adjusted to 80° C., which is circulated through the substrate temperature control plate. When the temperature of the substrate has reached 80° C., the tungsten heater for the boat charged with 70 g of Se is turned on and heats the vapor depositing boat up to 300° C. so that the Se may melt and begin evaporating. As shown in FIG. 10, at the time point $t_{6-1}$ when the Se has completely and uniformly melted, the shutter $S_1$ is opened and also at the same time shutter 15 is slid from the right to the left as viewed in the drawing to its fully opened position. Now, vapor depositing with Se on the whole surface of the substrate is started at the rate of 1.5 μ/min.

At the time point $t_{6-2}$ when the thickness of the vapor deposition film formed on the substrate reaches 5μ, the shutter $S_1$ is closed and the temperature of the circulating water is lowered from 80° C. to 65° C. Now, the tungsten heater for the other boat charged with 30 g of Se doped with Tl is turned on, which heats the vapor depositing boat up to 300° C. to melt the doped Se uniformly. At the time point $t_{6-3}$ when the substrate temperature becomes constant at 65° C., shutter $S_2$ is opened to effect vapor depositing with Se doped with Tl on the substrate.

At the time point $t'_{6-3}$ when the thickness of vapor deposition film on the substrate reaches about 8μ, the tungsten heater for the boat is turned off and at the same time shutter $S_1$ is opened again to effect vapor depositing on the substrate. At the time point $t_{6-4}$ when Se in the vapor depositing boat has almost completely evaporated off, the tungsten heater is turned off and vapor depositing is finished. The overall thickness of the vapor deposition film was 55μ. After breaking the vacuum and taking out the deposited substrate from the vessel, a polycarbonate resin coating of 20μ thickness is applied on it. In this manner, a photosensitive member was produced. The photosensitive member exhibited excellent characteristics without any fatigue effect similar to that of FIG. 4.

What we claim is:

1. An electrophotographic photosensitive member which exhibits no fatigue effect and which comprises an inorganic crystalline charge injection layer, a subsidiary charge injection layer overlaid on and in electrical contact with said charge injection layer, a photoconductive layer overlaid on and in electrical contact with said subsidiary charge injection layer and an electrically insulating layer overlaid on said photoconductive layer; said subsidiary charge injection layer being composed of an amorphous semiconductor selected from the group consisting of Se and Se-containing alloys, having a lower free charge density than that of said photoconductive layer and being able to make it easy to inject an amount of electric charge from the charge injection layer into the photoconductive layer; said charge injection layer having a higher free charge density and a lower dark resistance than those of said photoconductive layer, having a maximum dark resistance of 1×10 ohm-cm and serving as a main supply source of the electric charge to be injected into the photoconductive layer; and said photoconductive layer being composed of an amorphous semiconductor selected from the group consisting of Se and Se-containing alloys.

2. An electrophotographic photosensitive member as claimed in claim 1 wherein said photoconductive layer has a thickness between 10 and 100μ.

3. An electrophotographic photosensitive member as claimed in claim 1 wherein said subsidiary charge injection layer has a thickness between 0.2 and 15μ.

4. An electrophotographic photosensitive member as claimed in claim 1 wherein said subsidiary charge injection layer has a higher dark resistance than that of the photoconductive layer.

5. An electrophotographic photosensitive member as claimed in claim 4 wherein the dark resistance of said subsidiary charge injection layer is over $1\times10^{14}$ Ω.cm.

6. An electrophotographic photosensitive member as claimed in claim 1 wherein the dark resistance of said photoconductive layer is in the range of $1\times10^{14}$ to $1\times10^{12}$ Ω.cm, that of said subsidiary charge injection layer is over $1\times10^{14}$ Ω.cm and that of said charge injection layer is under $1\times10^{10}$ Ω.cm, and the dark resistance of said subsidiary charge injection layer is higher than that of the photoconductive layer.

7. An electrophotographic photosensitive member as claimed in claim 1 wherein said charge injection layer has, on its side opposite to the side on which said subsidiary charge injection layer is overlaid, an additional underlaid electrically insulating layer.

8. An electrophotographic photosensitive member as claimed in claim 1, further comprising an electrically-conductive or electrically-insulating support over which is overlaid said charge injection layer.

9. An electrophotographic photosensitive member as claimed in claim 1, wherein said electrically insulating layer is composed of an electrically-insulating resin.

10. An electrophotographic photosensitive member as claimed in claim 1, wherein said photoconductive layer is composed of p-type amorphous semiconductor and wherein said charge injection layer is a crystalline material selected from the group consisting of Te and crystalline p-type semiconductors.

11. An electrophotographic photosensitive member as claimed in claim 1, wherein said charge injection layer is a crystalline metal selected from the group consisting of nickel and platinum or a crystalline semiconductor selected from the group consisting of Te, Se, SeTe, SeAs, SeBi and SeSb.

12. An electrophotographic photosensitive member which exhibits no fatigue effect and which comprises a charge injection layer, a subsidiary charge injection layer overlaid on and in electrical contact with said charge injection layer, a photoconductive layer overlaid on and in electrical contact with said subsidiary charge injection layer and an electrically insulating layer overlaid on said photoconductive layer; said subsidiary charge injection layer being composed of an amorphous semiconductor material selected from the group consisting of Se and Se-containing alloys, having a lower free charge density and a higher dark resistance from those of said photoconductive layer and being able to make it easy to inject an amount of electric charge from the charge injection layer into the photoconductive layer; said charge injection layer being composed of a crystalline metal or a crystalline semiconductor selected from the group consisting of Te, Se and Se-containing alloys, having a higher free charge density and a lower dark resistance than those of said photoconductive layer wherein its maximum dark resistance is $1\times10^{10}$ ohm-cm, and serving as a main supply source of the electric charge to be injected into the photoconductive layer; and said photoconductive layer being composed of an amorphous semiconductor selected from the group consisting of Se and Se-containing alloys.

13. An electrophotographic photosensitive member as claimed in claim 12, wherein said Se-containing alloys are selected from the group consisting of SeTe, SeAs, SeBi and SeSb.

14. An electrophotographic photosensitive member as claimed in claim 12, wherein the dark resistance of said photoconductive layer is from $1\times10^{12}$ ohm-cm to $1\times10^{14}$ ohm-cm, and that of said subsidiary charge injection layer is greater than $1\times10^{14}$ ohm-cm.

* * * * *

UNITED STATES PATENT AND TRADEMARK OFFICE

CERTIFICATE OF CORRECTION

PATENT NO. : 4,202,937

DATED : May 18, 1977

INVENTOR(S) : TADAJI FUKUDA, ET AL

It is certified that error appears in the above—identified patent and that said Letters Patent is hereby corrected as shown below:

Column 5, Line 3, after "also" delete "slides";

Column 8, Line 42, after "SeTe" change "dope" to -- doped --;

Column 9, Line 40-41, after "thereafter" delete "man exhausts";

Column 9, Line 68, after "and" delete "finishes";

Column 11, Line 16, after "on" delete "on".

UNITED STATES PATENT AND TRADEMARK OFFICE

CERTIFICATE OF CORRECTION

PATENT NO. : 4,202,937

DATED : May 18, 1977

INVENTOR(S) : TADAJI FUKUDA, ET AL

It is certified that error appears in the above—identified patent and that said Letters Patent is hereby corrected as shown below:

Column 6, Line 29, after "the" change "photosensitive" to -- photoconductive --;

Column 6, Line 59, after "this" change "simple" to --sample--;

Column 9, Line 58, after "and" delete "allow";

Column 10, Line 2, after "of" "thickness is applied 20 μ" should read -- 20 μ thickness is applied --.

Signed and Sealed this

*Twenty-ninth* Day of *July 1980*

[SEAL]

*Attest:*

SIDNEY A. DIAMOND

*Attesting Officer*

*Commissioner of Patents and Trademar*